US008570225B2

(12) United States Patent
Shoji et al.

(10) Patent No.: US 8,570,225 B2
(45) Date of Patent: Oct. 29, 2013

(54) ANTENNA DEVICE AND MOBILE DEVICE

(75) Inventors: Hideaki Shoji, Tokyo (JP); Yoshiki Kanayama, Saitama (JP)

(73) Assignees: Sony Corporation, Tokyo (JP); Sony Mobile Communications Inc., Tokyo (JP)

( * ) Notice: Subject to any disclaimer, the term of this patent is extended or adjusted under 35 U.S.C. 154(b) by 311 days.

(21) Appl. No.: 12/955,535

(22) Filed: Nov. 29, 2010

(65) Prior Publication Data

US 2011/0237309 A1 Sep. 29, 2011

Related U.S. Application Data

(60) Provisional application No. 61/317,307, filed on Mar. 25, 2010.

(51) Int. Cl.
*H01Q 1/24* (2006.01)

(52) U.S. Cl.
USPC ..... 343/702

(58) Field of Classification Search
USPC ..... 343/721, 893, 897, 705, 700 MS, 846
See application file for complete search history.

(56) References Cited

U.S. PATENT DOCUMENTS

| | | | | |
|---|---|---|---|---|
| 7,091,907 | B2 * | 8/2006 | Brachat | 343/700 MS |
| 7,417,588 | B2 * | 8/2008 | Castany et al. | 343/700 MS |
| 7,539,510 | B2 * | 5/2009 | Toyoda et al. | 455/550.1 |
| 7,965,249 | B1 * | 6/2011 | Wolf et al. | 343/745 |
| 2003/0148784 | A1 * | 8/2003 | Sawamura et al. | 455/550 |
| 2004/0239575 | A1 * | 12/2004 | Shoji et al. | 343/770 |
| 2010/0225554 | A1 * | 9/2010 | Huang et al. | 343/821 |

FOREIGN PATENT DOCUMENTS

| | | |
|---|---|---|
| JP | 09-147639 | 6/1997 |
| JP | 2006-262414 | 9/2006 |

OTHER PUBLICATIONS

Chinese Office Action issued Jun. 26, 2013 in Chines Application No. 201110029363.4 with English translation, 24 pages.

* cited by examiner

*Primary Examiner* — Huedung Mancuso
(74) *Attorney, Agent, or Firm* — Oblon, Spivak, McClelland, Maier & Neustadt, L.L.P.

(57) ABSTRACT

An antenna element including a feeding part and a mesh part including at least a part of an area formed in a mesh state. The feeding part and an area of the antenna element in close proximity to the mesh part are formed of a finer mesh than the mesh part or formed of a solid.

11 Claims, 12 Drawing Sheets

ANTENNA DEVICE AND MOBILE DEVICE

CROSS REFERENCE TO RELATED APPLICATION

This application claims the benefit of priority of Provisional Application Ser. No. 61/317,307, filed Mar. 25, 2010, the entire contents of which is incorporated herein by reference.

BACKGROUND OF THE INVENTION

1. Field of the Invention

The present invention relates to an antenna device including an antenna element to be fed and to a mobile device including the antenna device.

2. Description of the Related Art

To date, a radio-communication antenna has become an indispensable part of a mobile device, such as a mobile telephone terminal, etc. In general, a part of an antenna sometimes disadvantageously protrudes from a housing of a device because it is necessary to ensure an electric characteristic (radiation characteristic) of the antenna. Also, in the case of a built-in antenna, the antenna occupies a substantial area inside a housing, and thus unfortunately the device becomes physically large in size.

In order to satisfy both necessities of the radiation characteristic and demands for design, there are requests for making an antenna section of a mobile device transparent.

Up to now, indium tin oxide (ITO) has been familiar as a transparent and conductive material. ITO is in rapidly increasing demand for a touch panel, etc.

As a transparent electrode material replacing a transparent ITO vapor-deposition electrode material used for an electromagnetic-wave shield, a liquid-crystal panel, and a solar cell, etc., a proposal has been made on a transparent electrode including a transparent supporting body and a conductive segment pattern formed thereon, and the conductive segment pattern has a thickness of 0.02 to 20 μm, and a line width of 0.5 to 100 μm (Japanese Unexamined Patent Application Publication No. 9-147639).

SUMMARY OF THE INVENTION

In a technique using the above-described indium tin oxide, there is a trade-off relationship between a degree of transparency of ITO and its conductivity. It is therefore difficult to satisfy both of them in a radio frequency (RF) band used for communication. Also, since a rare metal, indium, is used, there are problems in stable procurement of the material and in its cost.

The technique described in Japanese Unexamined Patent Application Publication No. 9-147639 is for use in an electrode material, and is not considered for an antenna.

Also, to date, it has been learned that in a reflective antenna, if sufficiently small holes (slots) with respect to its use frequency are formed on a conductor of an antenna, its performance can be substantially maintained. In a large-scale reflective antenna for satellite communication, a reflector having a mesh structure is sometimes employed in consideration of weight saving and wind resistance. As a result, an antenna having optical transparency is achieved. However, this is only for the case of using an antenna as a reflector, and not for the case of an antenna configuration in which a mesh part itself is used as a primary radiator to be fed.

The present invention has been made in such a background. It is desirable to provide an antenna device including an antenna element to be fed and having optical transparency without deteriorating a radiation characteristic of the antenna at a relatively low price.

According to one exemplary embodiment, the specification discloses an antenna element corresponding to a specific frequency band, the antenna element comprising: a feeding part; and a mesh part including at least a part of an area formed in a mesh state, wherein the feeding part and an area of the antenna element in close proximity to the mesh part are formed of a finer mesh than the mesh part or formed of a solid.

A portion of the antenna element is configured to be bent, and the bent portion is formed of a finer mesh than the mesh part or formed of a solid.

A density of the mesh part is changed stepwise or continuously.

The antenna element has a ground section, and only an area other than the feeding part and the ground section is formed in the mesh state.

A relationship between a line width W and a line interval D of the mesh part substantially satisfies $D \geq 22W$.

An aperture rate of the mesh part is 91% or more.

The line width W is equal to or greater than double a skin depth of a conductive material of the antenna element with respect to a target frequency of the antenna element.

A width of an outermost peripheral line of the mesh part is greater than a width of an inner line in the mesh part.

According to another exemplary embodiment, the specification discloses an antenna device. The antenna device includes a first antenna element including a first feeding part; and a first mesh part including at least a part of an area formed in a mesh state, wherein the first feeding part and an area of the first antenna element in close proximity to the first mesh part are formed of a finer mesh than the first mesh part or formed of a solid; and a second antenna element including a second feeding part; and a second mesh part including at least a part of an area formed in a mesh state, wherein the second feeding part and an area of the second antenna element in close proximity to the second mesh part are formed of a finer mesh than the second mesh part or formed of a solid.

The first antenna element corresponds to a first target frequency, and the second antenna element corresponds to a second target frequency.

A relationship between a line width W and a line interval D of each of the first and second mesh parts substantially satisfies $D \geq 22W$.

The line width W of each of the first and second mesh parts is equal to or greater than double a skin depth of a conductive material of each of the first and second antenna elements, respectively, with respect to the first and second target frequencies of each of the first and second antenna elements.

An aperture rate of each of the first and second mesh parts is 91% or more.

The first and second antenna elements are formed on a flexible printed circuit made of a transparent material.

The antenna device further includes a transparent supporting member to which the flexible printed circuit is adhered.

According to another exemplary embodiment, the specification discloses a mobile device comprising an antenna element including a feeding part; and a mesh part including at least a part of an area formed in a mesh state, wherein the feeding part and an area of the antenna element in close proximity to the mesh part are formed of a finer mesh than the mesh part or formed of a solid; a light emitting element; and a light emitting section configured to output light emitted from the light emitting element through at least the mesh part of the antenna element.

The mobile device is a mobile telephone terminal, and at the time of receiving at least a telephone call or a message at the mobile telephone terminal, the light emitting section is configured to display an icon, a symbol, or a character.

A relationship between a line width W and a line interval D of the mesh part of the antenna element substantially satisfies D≥22W.

The line width W is equal to or greater than double a skin depth of a conductive material of the antenna element with respect to a target frequency of the antenna element.

An aperture rate of the mesh part of the antenna element is 91% or more.

The above-described mobile device is, for example a mobile telephone terminal. At the time of receiving at least a telephone call or a mail of the mobile telephone terminal, the light emitting section displays an icon, a symbol, or a character with lighting in order to inform the reception. In the light emitting display, the mesh part of the antenna element has optical transparency, and thus there is no problem.

By the present invention, at least a part of the area of the antenna element is formed in a mesh state, and the feeding part and an area in the vicinity thereof are of a finer mesh or solid. Thus, it is possible to obtain optical transparency without adversely affecting the radiation characteristic of the antenna. As a result, in a mobile device using the antenna device, it becomes possible to achieve high optical transparency in the antenna element section, and to give high degree of freedom in design creativity.

BRIEF DESCRIPTION OF THE DRAWINGS

FIG. 2 is a schematic sectional view of a mesh part of a flexible printed circuit in

FIG. 1;

DESCRIPTION OF THE PREFERRED EMBODIMENTS

In the following, detailed descriptions will be given of preferred embodiments of the present invention with reference to the drawings.

Figure 1:
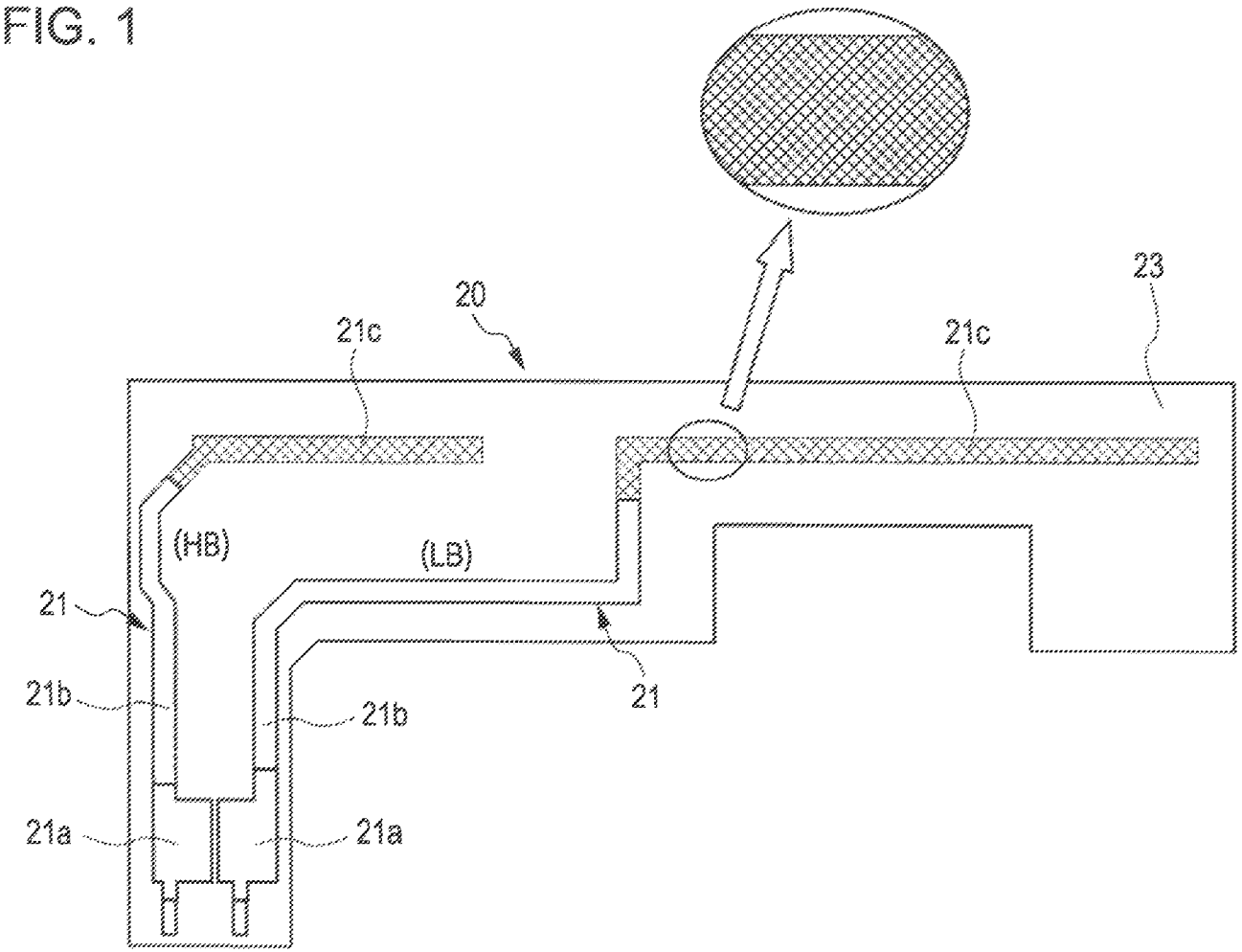
FIG. 1 is a diagram illustrating a schematic configuration of an antenna device according to an embodiment of the present invention.

FIG. 1 is a diagram illustrating a schematic configuration of an antenna device according to an embodiment of the present invention. The antenna device includes a flexible printed circuit (FPC) 20 as a flexible part. In this embodiment, two conductive patterns for a high band (HB) and a low band (LB) are formed on the flexible printed circuit 20 on a transparent plate 23 as antenna elements 21 that are fed as primary radiators. In this example, a multiband linear antenna corresponding to a plurality of frequency bands is taken as an example. For multiband, for example, an 800-MHz band and 1950 MHz for a cellular phone, and 2.5 GHz for Bluetooth (registered trademark), etc., are considered.

Both of the antenna elements 21 have a gold-plated contact point 21*a*, which is a feeding part to be fed, and a non-mesh part 21*b* following to the gold-plated contact point 21*a*, and a mesh part 21*c* further following to the non-mesh part 21*b*.

The mesh part 21*c* is a part which is formed in a mesh state in order to make at least a part of the area of the antenna element 21 optically transparent. In the present specification, a "mesh" means that the antenna element plane has netlike openings. For a shape of the mesh, various shapes are considered as described later.

Preferably, an area in the vicinity of the feeding part of the antenna element 21 is of a finer mesh or solid (not empty inside). In this example, each antenna element 21 has a length of ¼ wavelength (λ/4) of a corresponding frequency, and about a half of the end-side of the antenna element 21 is used as the mesh part 21*c*. The non-mesh part 21*b* in this embodiment is solid, and is disposed at the feeding side for the reason described later.

Figure 2:
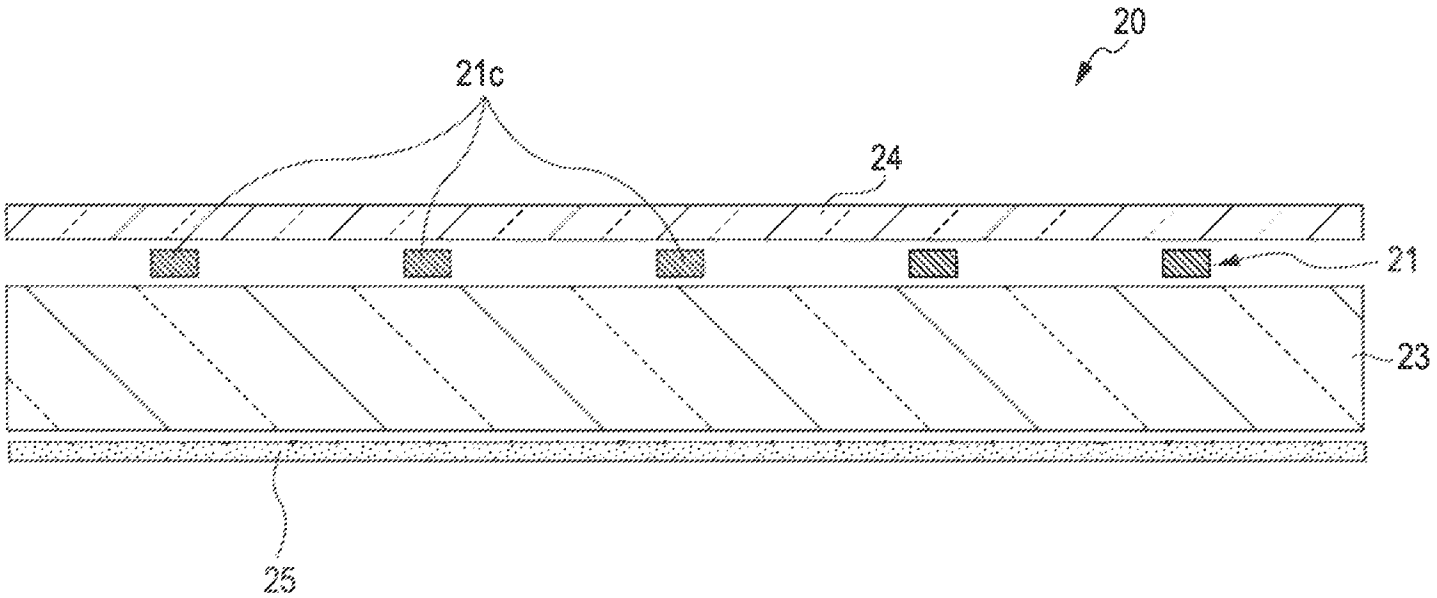

FIG. 2 illustrates a schematic sectional view of the mesh part 21*c* of the flexible printed circuit 20.

The antenna element 21 is formed on the transparent plate 23 made of a flexible transparent material. In this example, the transparent plate 23 has a thickness of about 25 to 100 μm, and the antenna element 21 has a thickness of about 10 μm. The mesh part 21*c* has a configuration in which conductive lines are arranged at regular intervals. In this example, a transparent cover layer 24 is formed on the antenna element 21 as a protection layer. Also, a layer of a transparent adhesive 25 is disposed on the lower surface of the transparent plate 23. As described later, this allows to be adhered to a supporting body (supporting member).

The configuration of the flexible printed circuit 20 is not limited to the configuration in FIG. 2. For example, the flexible printed circuit 20 may be sandwiched between two transparent members having opposed faces facing each other. In that case, the layer of the transparent adhesive 25 may be omitted.

Figure 3:
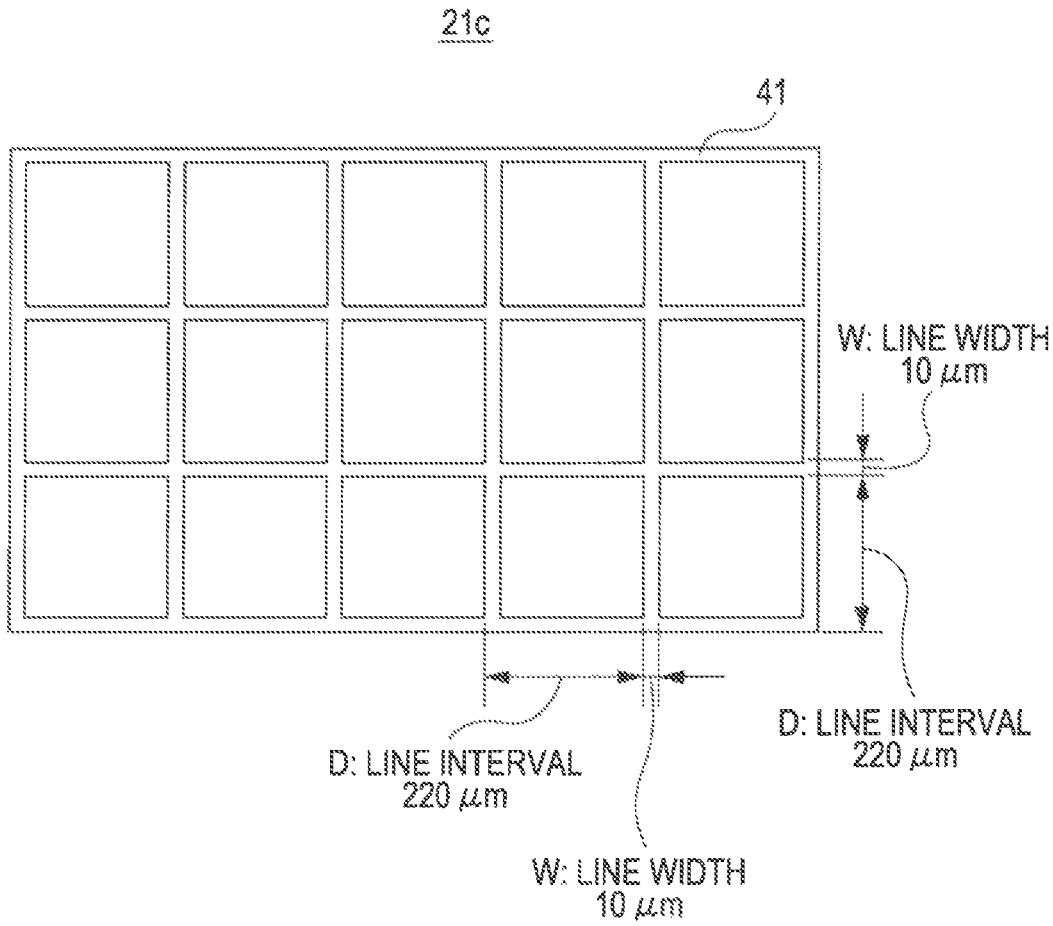
FIG. 3 is a diagram illustrating an example of a configuration of a mesh part of an antenna element in FIG. 1.

FIG. 3 illustrates an example of a configuration of the mesh part 21*c*. In this example, the meshes are square, and a conductive line 41 has a line width of 10 μm and a line interval of 220 μm. Two intersecting lines are assumed to be electrically connected. Thereby, a current-flowing path has a planar structure, thereby making it possible to reduce a resistance component. In order to obtain a stable contact, it is preferable not to use a fabric structure, but is preferable to use a plate-shaped structure (a metal plate, a copper plate in this embodiment) with etching.

At the time of determining the line width and the line interval of the conductive line 41, it is necessary to satisfy both requests of the radiation characteristic of the antenna and the light transmittance of the mesh part.

Figure 4:
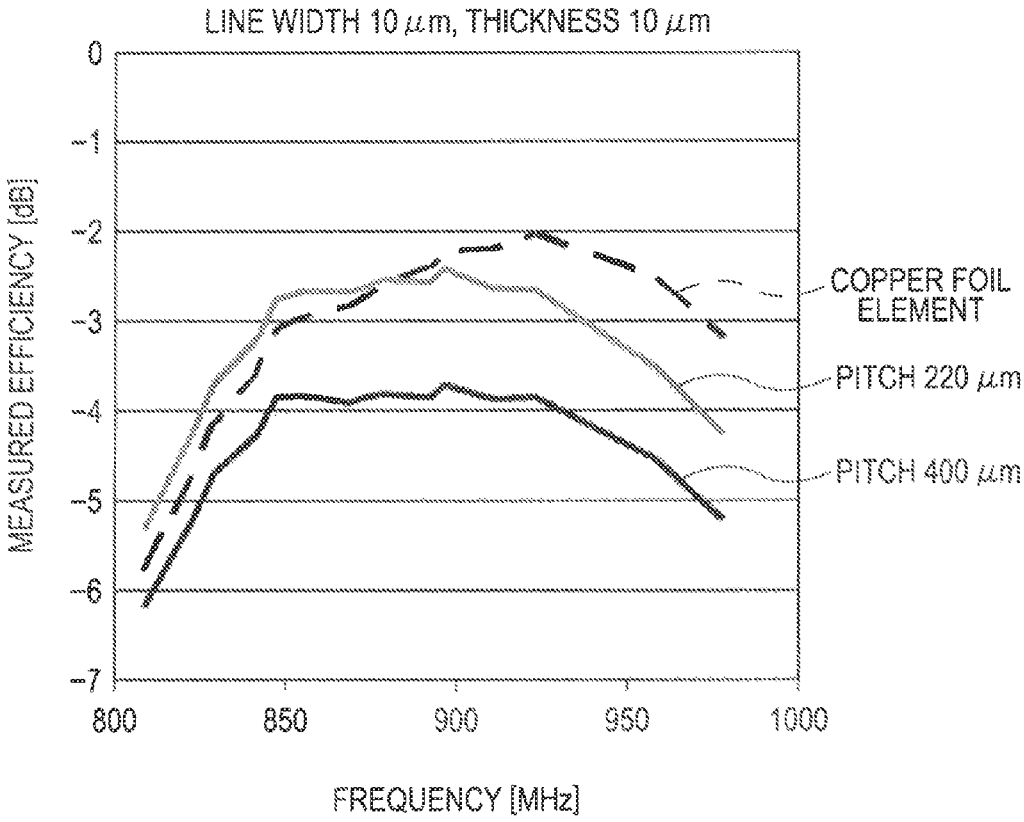
FIG. 4 is a graph illustrating a study result of an experiment in which the present invention is applied to an antenna operating at an 800-MHz band, which is often employed in a mobile telephone terminal.

FIG. 4 is a graph illustrating a study result of an experiment in which the present invention is applied to an antenna operating at an 800-MHz band, which is often employed in a mobile telephone terminal. In this graph, the horizontal axis shows frequency (MHz), and the vertical axis shows measured antenna efficiency (dB). Experiments were conducted for an antenna element made of a copper-foil element not having a mesh part, and for an antenna element (made of copper) having a mesh part. For the antenna elements having a mesh part, two cases of conductive lines were used. One of the cases is a conductive line having a line width of 10 μm, a thickness of 10 μm, and a line interval (pitch) of 220 μm. The other of the cases is a conductive line having a line interval (pitch) of 400 μm and same dimensions as those of the former.

From the graph in FIG. 4, it is possible to confirm that the antenna elements having a mesh part have a resonance frequency slightly shifted to a low-frequency side compared with a copper foil element not having a mesh part, but have a substantially similar antenna performance in the case of having a pitch of 220 μm. It is possible to confirm that in the case of having a pitch of 400 μM, the intervals of the mesh are too coarse so that the conductor loss increases, deteriorating the antenna efficiency by about 1 dB.

At the time of determining the line width of the conductive line of the mesh part, the larger the line width, the better the radiation characteristic of the antenna is obtained, and the smaller the line interval, the better the radiation characteristic is obtained. On the other hand, in order to obtain light (visible light) of a desired level or more, the smaller the line width, the better the result is obtained. Also, the longer the line interval, the better the result is obtained.

In this manner, there is a trade-off relationship between the radiation characteristic of an antenna and a light transmittance. Thus, in order to satisfy both requests, it becomes necessary to study the followings.

In order to determine a lower limit of a line width (and thickness) of the conductive line so as to improve the light transmittance without increasing a conductor loss, it is necessary to consider a skin depth for a targeted frequency of the antenna element. A high-frequency current has a characteristic called a skin effect in which the current flows much on a surface of a conductor. The skin depth is an index indicating the depth of an "outer layer of a skin" on which the current substantially flows.

In consideration of both directions of the upper surface and the lower surface of the conductive line, it is thought that the line width (and thickness) is necessary to be two times the skin depth in order not to increase a conductor loss. For example, if the conductor material is copper, the skin depth for low-band frequency 850 MHz is about 3 μm, and thus a line width that is necessary at minimum becomes 5 to 7 μm. The line width of 10 μm in the above-described example is said to be a sufficient line width from a viewpoint of the radiation characteristic of the antenna.

In this manner, it is desirable to set the line width W (and thickness) of the conductive line of the mesh part to two times the skin depth of the conductor material for the target frequency of the antenna element.

In this regard, for a high band, the skin depth has a smaller value, and thus it is thought that the line width determined for a low band can be sufficiently used.

In order to obtain a light (visible) transmittance of a desired level or more, it is more advantageous as the line width of the conductive line constituting the mesh part 21*c* of the antenna element 21 becomes smaller, and also as the line interval becomes longer. If it is assumed that the light transmittance obtained from the relationship between the line width W and the line interval D, shown in FIG. 3, is necessary at minimum, the relationship between the line width W and the line interval D becomes substantially $D \geq 22W$.

In this case, it is possible to consider an aperture rate as a degree of light (visible light) transmittance. The aperture rate is a rate of an aperture section per an area of the mesh part. In the example in FIG. 3, the aperture rate is obtained by the following expression.

$$\text{Aperture rate}=220\times220/\{(220+10)\times(220+10)\}=0.915$$

That is to say, that an aperture rate is preferably 91% or more in order to obtain a desired transmittance.

Figure 5A:
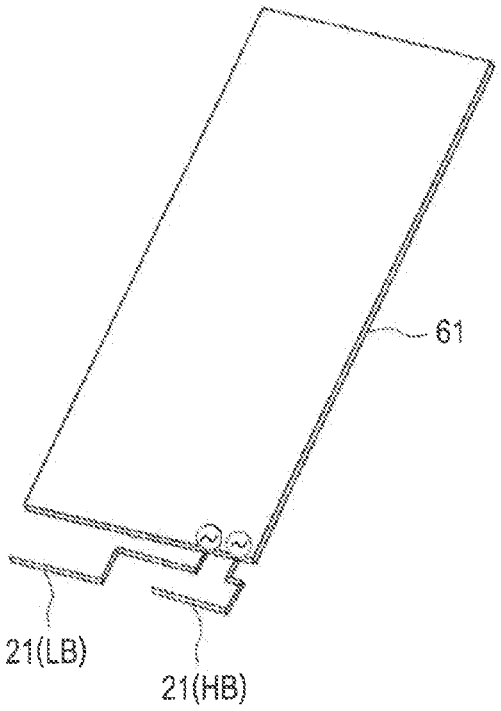
FIGS. 5A, 5B, and 5C are diagrams illustrating a current distribution on the antenna element in the antenna device shown in FIG. 1.

FIG. 5 illustrates an electric current distribution on the antenna element in the antenna device shown in FIG. 1. In this example, as shown in FIG. 5A, the antenna device includes a combination of a low-band antenna element 21 (LB) and a high-band antenna element 21 (HB) with respect to a ground conductor 61. Feed points are disposed between the individual antenna elements 21 and the ground conductor 61, and an antenna matching circuit not shown in the figure here is disposed.

Figure 5B:
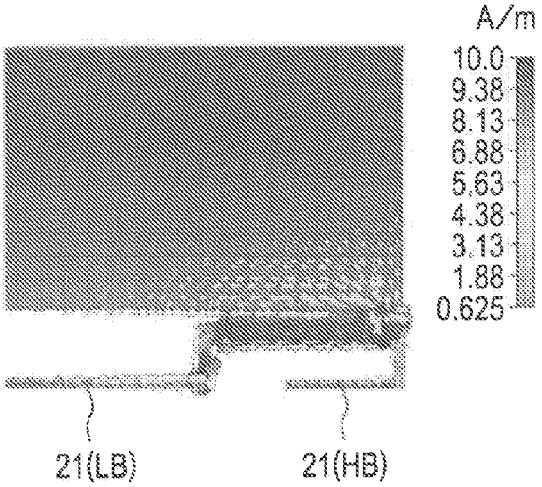
Figure 5C:
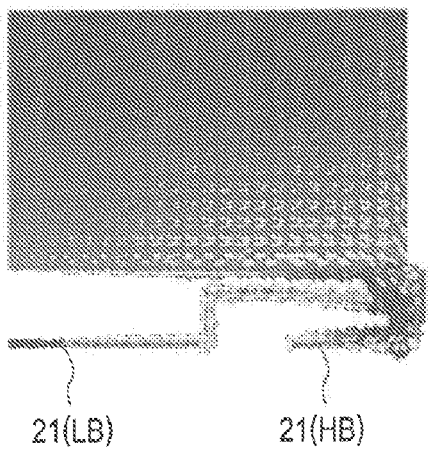

As is understood from FIG. 5B, for a low-band (850 MHz in this example) frequency band, a large amount of current flows through the low-band antenna element 21 (LB), and further most of the current concentrates in the vicinity of the feed point. In the same manner, as is understood from FIG. 5C. For a high-band (1950 MHz in this example) frequency band, a large amount of current flows through the high-band antenna element 21 (HB), and further most of the current concentrates in the vicinity of the feed point.

In this manner, in the case of a ¼-wavelength (λ/4) antenna, which is often employed in a mobile telephone terminal, a large amount of current flows in the vicinity of the feed point. Thus, as described above, if the mesh of that part is made solid or fine, it is possible to reduce deterioration of an antenna efficiency by a conductor loss which is caused by concentration of current on a thin antenna element.

Figure 6A:
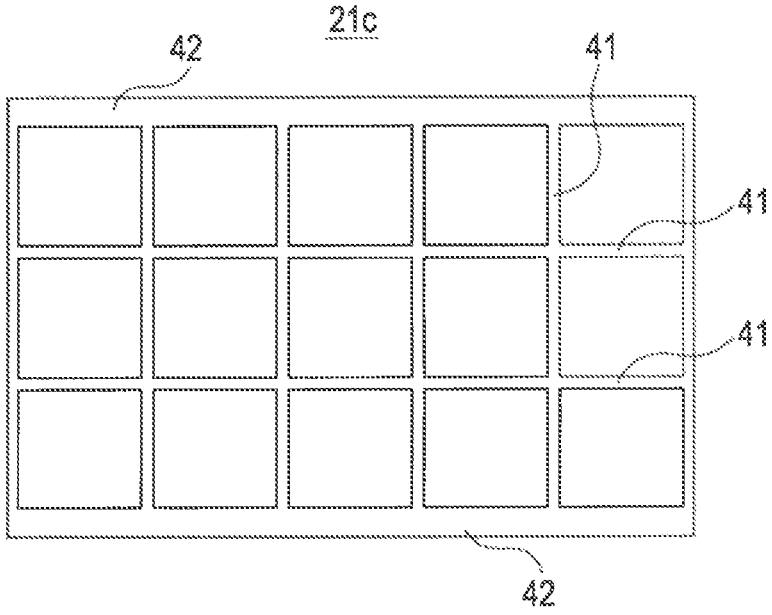
FIGS. 6A and 6B are diagrams illustrating variations of the mesh part according to an embodiment of the present invention.
Figure 6B:
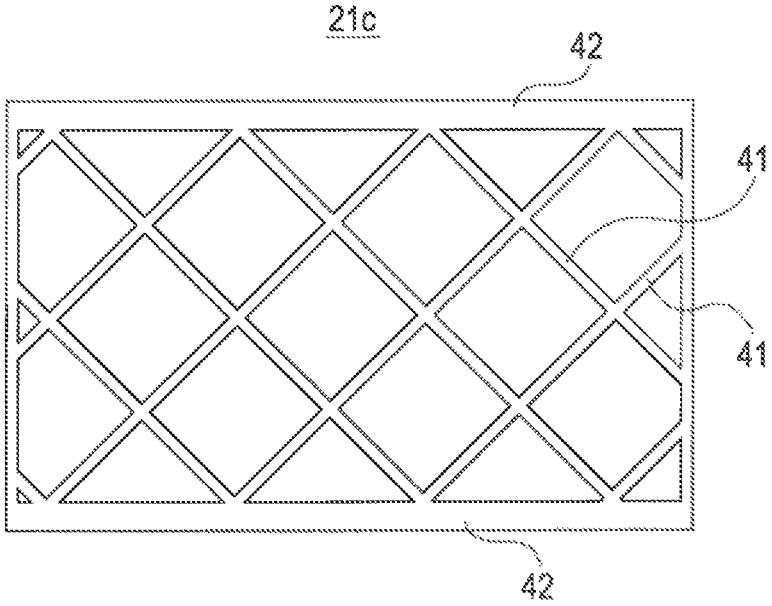

FIGS. 6A and 6B illustrate variations of the mesh part 21*c*. In this example, in the mesh part 21*c*, a line width of the conductive line 42 in an outermost periphery of the mesh part along a longitudinal direction of the antenna element, through which much current flows, is greater than a line width of inner conductive lines 41. FIG. 6A illustrates a mesh structure in which inner conductive lines 41 are in parallel with the outermost conductive line 42. FIG. 6B illustrates a mesh structure in which inner conductive lines 41 are obliquely arranged. The line width W and the line interval D of the mesh structure in FIG. 6B are determined by the thinner conductive line 41.

Figure 7A:
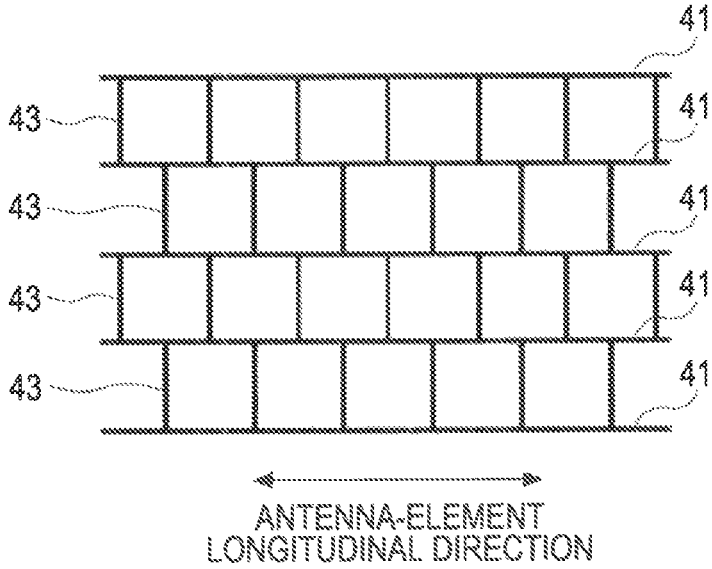
FIGS. 7A and 7B are diagrams illustrating further variations of a mesh structure of the mesh part according to an embodiment of the present invention.
Figure 7B:
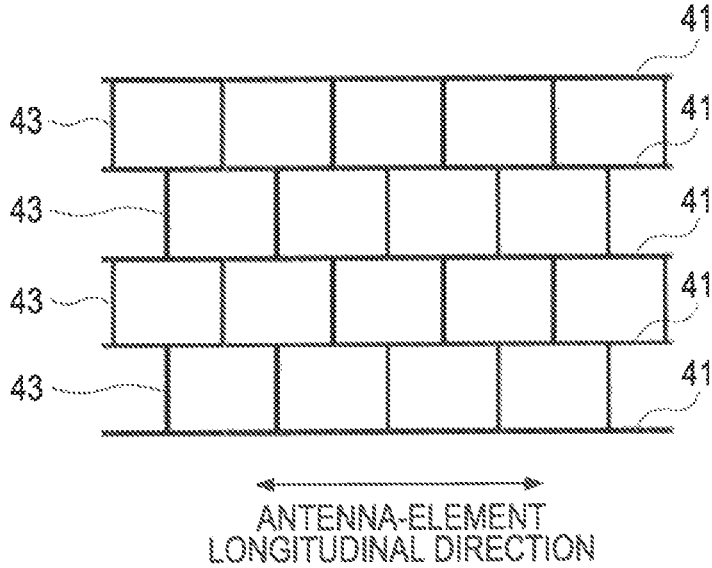

FIGS. 7A and 7B illustrate further variations of a mesh structure of the mesh part. The above-described examples have shown the structures in which at least internal conductive lines 41 are parallel lines that are perpendicular to each other. However, in the example in FIGS. 7A and 7B, the conductive lines 41 along the longitudinal direction of the antenna element are the same as the above-described examples, but conductive lines 43 are perpendicular to the conductive lines 41 are short line segments connecting adjacent conductive lines 41. The conductive lines 43 are disposed at regular intervals along the longitudinal direction of the antenna element. However, their phases are shifted between individual conductive lines 41. In this example, the phase is shifted by 180 degrees, and blocks corresponding to meshes look like bricklaying. In this regard, the amount of phase shift is not limited to 180 degrees.

Although not shown in the figure in particular, in the mesh structure in FIGS. 7A and 7B, as shown in FIGS. 6A and 6B, it is possible to have a configuration in which a line width of the conductive line in an outermost periphery of the mesh part along a longitudinal direction of the antenna element, through which much current flows, is made greater than a line width of inner conductive lines.

Figure 8:
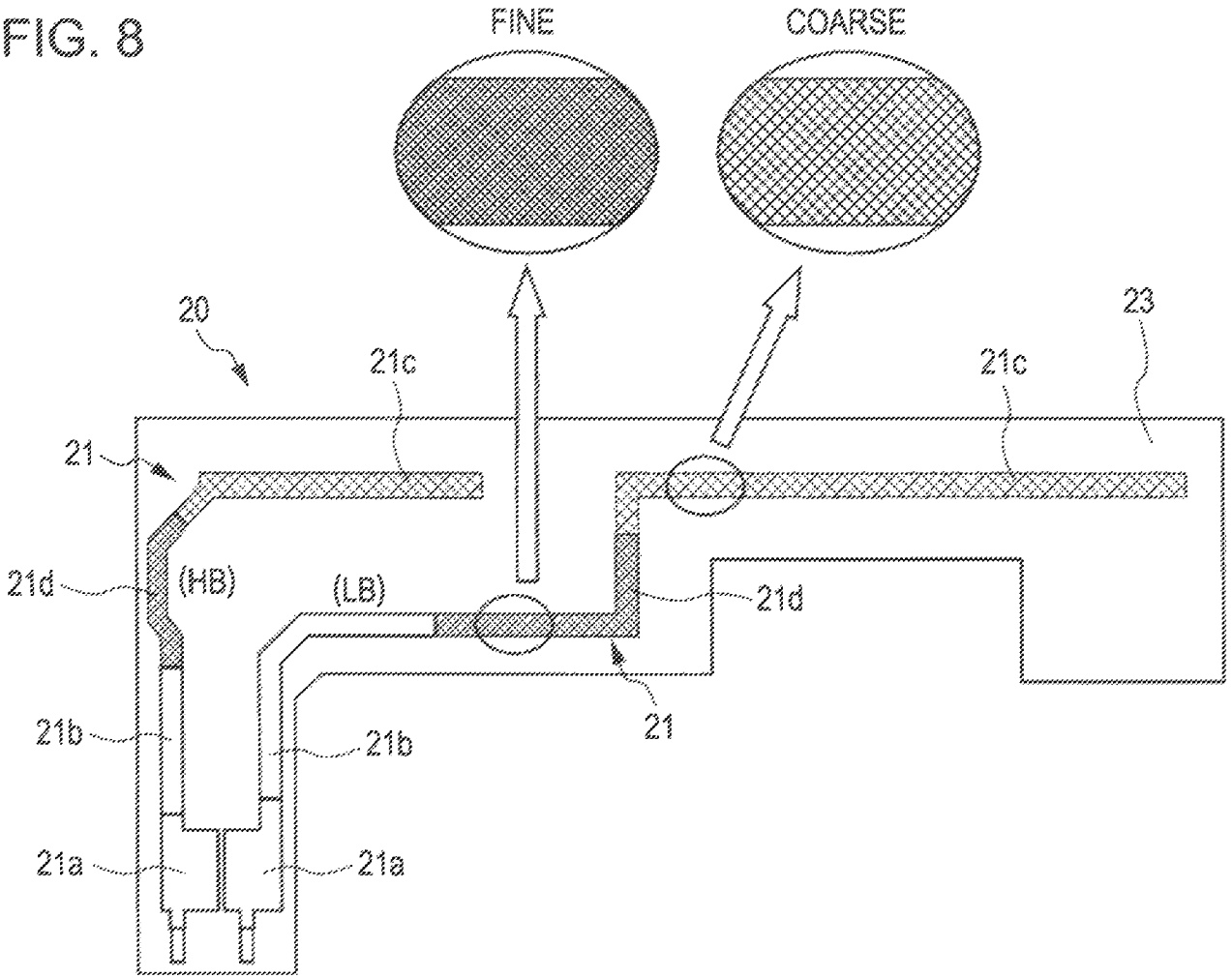
FIG. 8 is a diagram illustrating another example of an antenna element having a plurality of stages of mesh densities.

FIG. 8 illustrates another example of the antenna element 21 having a plurality of stages of mesh densities. Same reference numerals are given to same elements as those shown in FIG. 1, and overlapped descriptions are omitted. In this example, a mesh part 21*d* having a higher mesh density than the mesh part 21*c* is disposed between the mesh part 21*c* and the non-mesh part 21*b*. That is to say, in this example, the mesh density is changed in two stages. The change in the mesh density is not limited to two stages, and the mesh density may be changed in more stages. Alternatively, the mesh density may be changed continuously.

Figure 9:
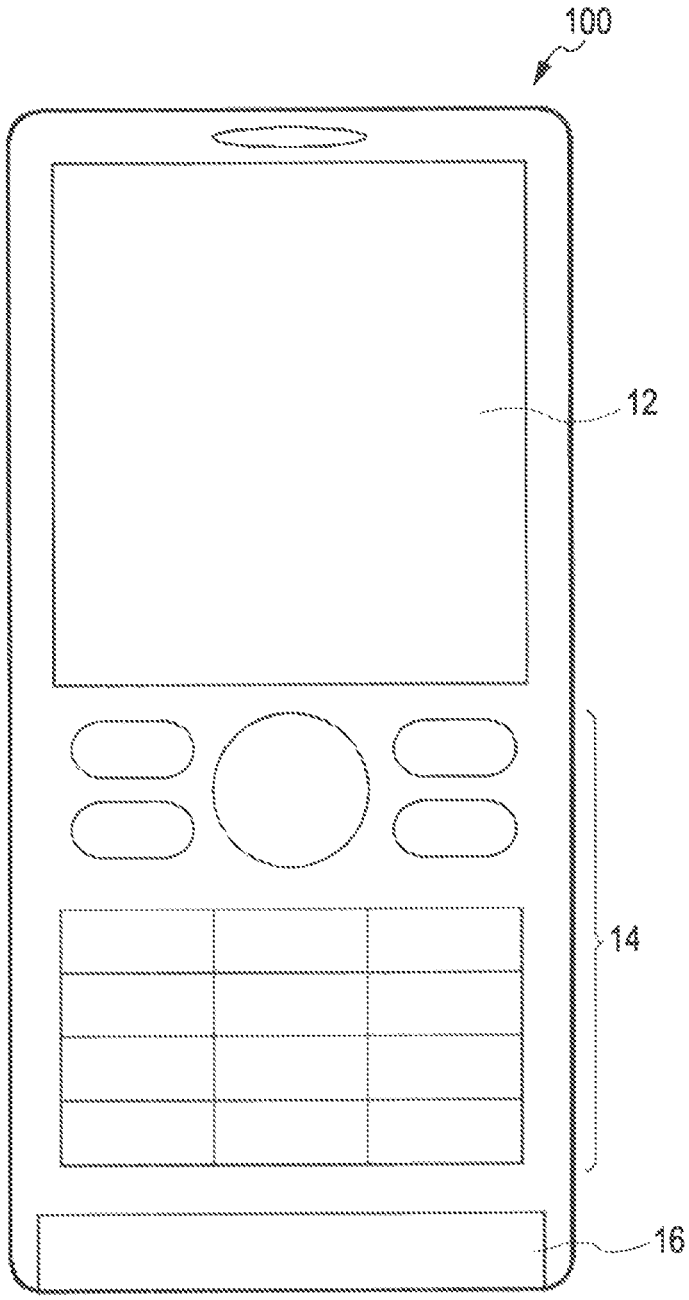
FIG. 9 is a front view of a mobile telephone terminal as a mobile device using an antenna device according to an embodiment of the present invention.

FIG. 9 illustrates a front view of a mobile telephone terminal 100 as a mobile device using an antenna device according to the present embodiment.

Figure 10A:
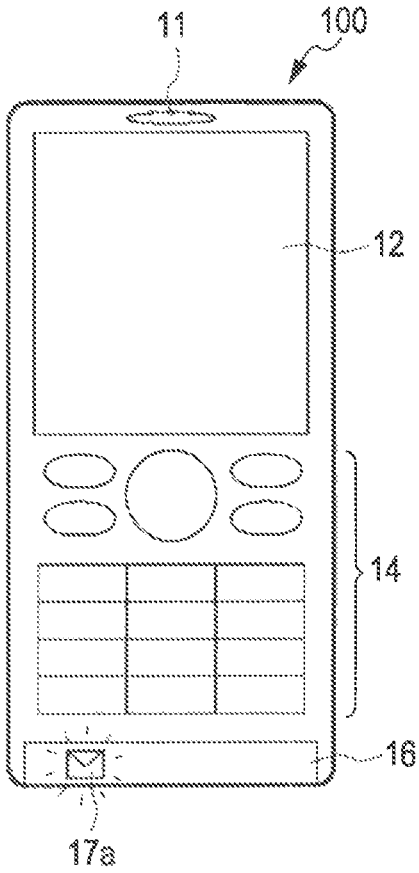
FIGS. 10A and 10B are diagrams illustrating an example of a display of an icon emitting light (or blinking), etc., in the mobile telephone terminal in FIG. 9.
Figure 10B:
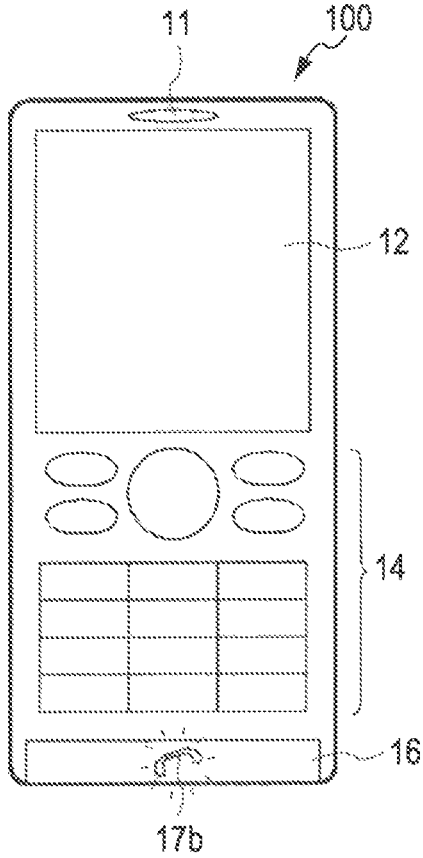

The mobile telephone terminal 100 includes a light-emitting section 16 in which an antenna device according to the present invention is disposed inside in addition to a display section 12 such as a liquid crystal device and an operation section 14 including various operation keys, such as a numeric keypad, etc. In this example, the light-emitting section 16 is disposed at the lower-end part of the mobile telephone terminal 100. However, the position is not limited to the lower-end part. For example, the light-emitting section 16 may be disposed at the upper-end position. The light-emitting section 16 is an electric decoration part outputting light emitted from an internally disposed light-emitting element to the outside through the transparent antenna device. For example, the light-emitting section 16 can display an indicator representing a specific application selectively by lighting. In this example, the cases of displaying icons 17*a* and 17*b* by lighting when a telephone call and a mail are received are shown. At mail reception time, as shown in FIG. 10A, the icon 17*a* emits light (or blinks), etc. At telephone-call reception time, as shown in FIG. 10B, the icon 17*b* emits light (or blinks), etc. This kind of control is performed by an internal control section (including a CPU and a program memory) not shown in the figure.

Figure 11B:
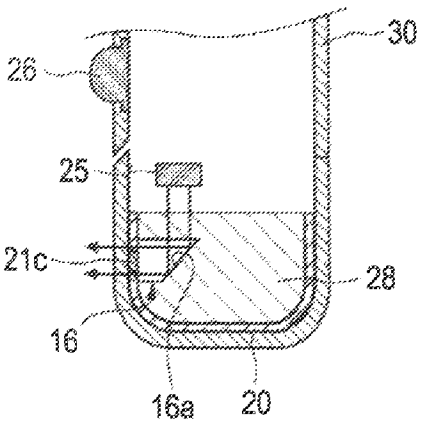
FIGS. 11A, 11B, and 11C are diagrams illustrating a schematic configuration of a lower part of the mobile telephone terminal in FIG. 9.
Figure 11C:
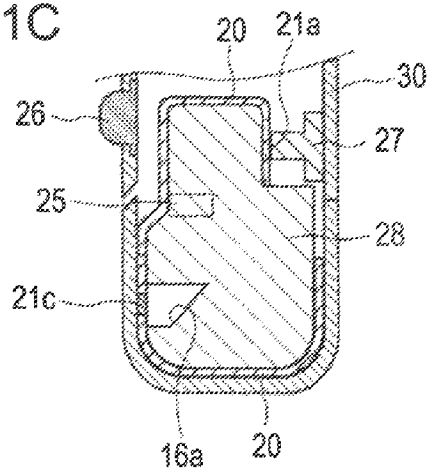
Figure 11A:
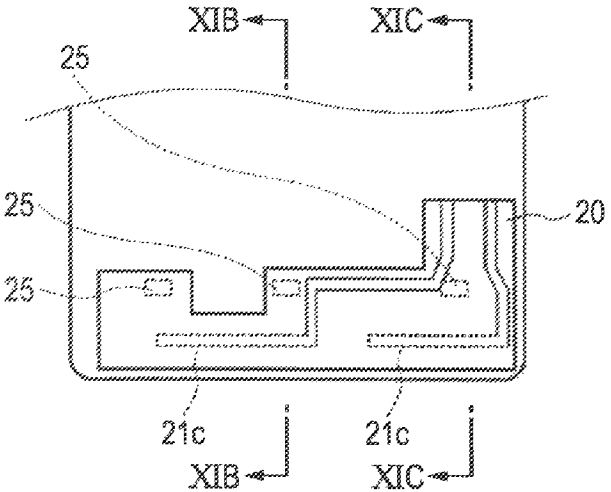

FIGS. 11A, 11B, and 11C illustrate a schematic configuration of a lower part of the mobile telephone terminal 100 including the light-emitting section 16. FIG. 11A illustrates an inner front view, FIG. 11B illustrates a sectional view taken along XIB-XIB, and FIG. 11C illustrates a sectional view taken along XIC-XIC.

As is apparent in FIG. 11C, the flexible printed circuit 20 is fixed by being folded around the periphery of the transparent supporting body 28. The fixing can be carried out by the above-described adhesive. The antenna-element part corresponding to the bending part of the flexible printed circuit 20 can be formed to be of a finer mesh or solid so that the strength of the antenna element can be improved. Thus, it is possible to ensure stable flexibility performance.

A gold-plated contact point 21*a* of the antenna element 21 is fixed in contact with a feed point 27 disposed in a housing 30. The feed point 27 is connected to a circuit board, not shown in the figure, in the housing. An outer shell of the light-emitting section 16 is also formed by a transparent member. LEDs 25 (three pieces in this example) are disposed as light-emitting elements for lighting the light-emitting section 16 in the housing. Light from the LED 25 passes through the supporting body 28, and changes direction by 90 degrees on a 45-degree reflection plane 16*a* formed on the supporting body 28, and goes outside of the surface side on which operation keys 26 of the operation section 14 are disposed. In that case, although the antenna element is disposed in a light path, that part is formed by the mesh section 21*c* so that light is transmitted through that part. Thus, the part does not prevent the surface of the light-emitting section 16 from emitting light. The reflection plane 16*a* is formed by an air hole, but the other optical parts, such as a prism, etc., may be used.

In this regard, the flexible printed circuit 20 is configured to be folded around the periphery of the supporting body 28 from the front side to the back side, but may be configured to be terminated at the front side. The above-described icons 17*a* and 17*b* may be formed on the outer shell of the light-emitting section 16, or on the supporting body 28 side, for example, on the reflection plane 16*a*. The indicator representing an application is not limited to an icon, but may be a symbol or a character.

In the example in FIG. 9, a so-called straight-type mobile telephone terminal is shown. However, the type of its housing is not limited to this. For example, a folding type or a slide type in which a housing is separated into an upper part and a lower part may be used.

In the above, a description has been given of a linear antenna. However, the present invention is not limited to a linear antenna. FIG. 12 illustrates an example of a configuration in the case where the present invention is applied to a planar antenna.

Figure 12A:
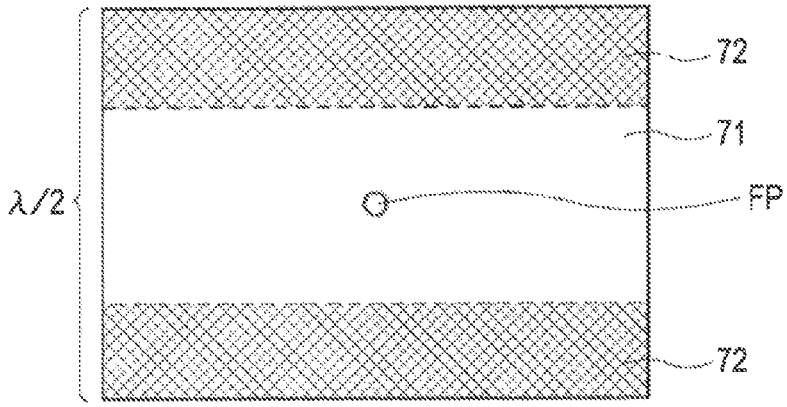
FIGS. 12A, 12B, 12C, and 12D are diagrams illustrating an example of a configuration in the case where the present invention is applied to a planar antenna.

FIG. 12A illustrates an example of a microstrip antenna having a planar antenna element having a width of $\lambda/2$. In this case, a feed point (FP) is positioned in the center of the antenna element. A central area 71 in the width direction, including the feed point, which has a high current density, is made solid, and side-end areas 72 away from the feed point in the width direction have a mesh structure.

Figure 12B:
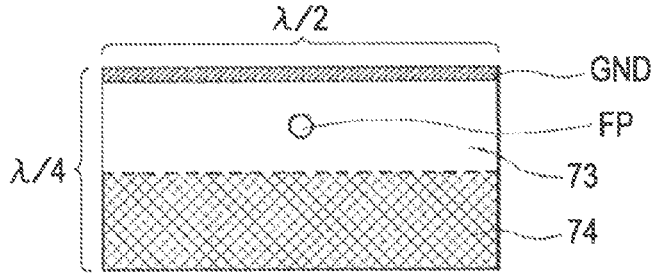

FIG. 12B illustrates an example of a planar antenna element having a width of $\lambda/4$, and one side end in the width direction is GND, and a feed point (FP) is disposed at a position slightly away from the GND. In this case, one end area 73 including GND and a feed point, having a high current density, is made solid. A side-end area 74 away from the GND and the feed point has a mesh structure.

Figure 12C:
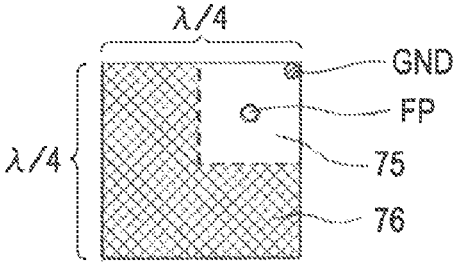

FIG. 12C illustrates an example of a square planar antenna having both a vertical and a horizontal sizes of $\lambda/4$. One corner of the square is set to be a GND point, and a feed point (FP) is disposed at a slightly apart position from the GND point. One corner area 75 including the GND point and the feed point, which has a high current density, is made solid, and a surrounding area 76 away from the GND point and the feed point has a mesh structure.

Figure 12D:
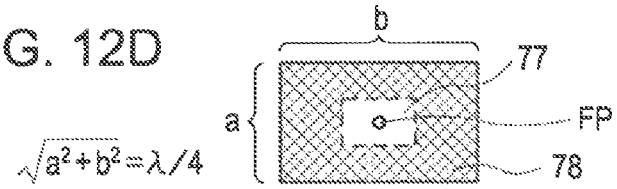

FIG. 12D illustrates an example of a rectangular planar antenna having a vertical size a, a horizontal size b, and a diagonal line length of $\lambda/4$. A feed point (FP) is positioned in the center of the antenna element. A central area 77 including the feed point, which has a high current density, is made solid, and a surrounding area 78 away from the feed point has a mesh structure.

In this manner, in the case of a planar antenna, if an antenna element has a GND section, an area other than a feed point and a GND section can be in a mesh state.

In the same manner as described in the linear antenna, in the mesh section, the mesh densities may be changed stepwise, or may be changed continuously.

Descriptions have been given of preferable embodiments of the present invention. Various variations and modifications are possible in addition to the above-described embodiments. For example, copper is taken as an example of a material of an antenna element. However, the material is not limited to copper, and the other metals and conductive materials may be used.

A description has been given of a multiband antenna device. However, the present invention is not limited to a multiband antenna device, and may also be applied to a singleband antenna device.

It should be understood by those skilled in the art that various modifications, combinations, sub-combinations and alterations may occur depending on design requirements and other factors insofar as they are within the scope of the appended claims or the equivalents thereof.

What is claimed is:

1. An antenna element comprising:

a feeding part; and a mesh part including at least a part of an area formed in a mesh state, wherein the feeding part and an area of the antenna element in close proximity to the mesh part are formed of a finer mesh than the mesh part or formed of a solid, a portion of the antenna element is configured to be bent, and the bent portion is formed of a finer mesh than the mesh part or formed of a solid, a relationship between a line width W and a line interval D of the mesh part substantially satisfies D≥22W, and the line width W is equal to or greater than double a skin depth of a conductive material of the mesh part with respect to a target frequency of the antenna element.

2. The antenna element according to claim 1, wherein a density of the mesh part is changed stepwise or continuously.

3. The antenna element according to claim 1, wherein the antenna element has a ground section, and only an area other than the feeding part and the ground section is formed in the mesh state.

4. The antenna element according to claim 1, wherein a width of an outermost peripheral line of the mesh part is greater than a width of an inner line in the mesh part.

5. An antenna device comprising:

a first antenna element including a first feeding part; and a first mesh part including at least a part of an area formed in a mesh state, wherein the first feeding part and an area of the first antenna element in close proximity to the first mesh part are formed of a finer mesh than the first mesh part or formed of a solid; and a second antenna element including a second feeding part; and a second mesh part including at least a part of an area formed in a mesh state, wherein the second feeding part and an area of the second antenna element in close proximity to the second mesh part are formed of a finer mesh than the second mesh part or formed of a solid, and wherein a portion of each of the first and second antenna elements is configured to be bent, and the bent portion is formed of a finer mesh than the first and second mesh parts or formed of a solid, a relationship between a line width W and a line interval D of each of the first and second mesh parts substantially satisfies D≥22W, and the line width W of each of the first and second mesh parts is equal to or greater than double a skin depth of a conductive material of each of the first and second mesh part, respectively, with respect to the first and second target frequencies of each of the first and second antenna elements.

6. The antenna device of claim 5, wherein the first antenna element corresponds to a first target frequency, and the second antenna element corresponds to a second target frequency.

7. The antenna device according to claim 5, wherein the first and second antenna elements are formed on a flexible printed circuit made of a transparent material.

8. The antenna device according to claim 7, further comprising:

a transparent supporting member to which the flexible printed circuit is adhered.

9. A mobile device comprising:

an antenna element including a feeding part; and a mesh part including at least a part of an area formed in a mesh state, wherein the feeding part and an area of the antenna element in close proximity to the mesh part are formed of a finer mesh than the mesh part or formed of a solid, a portion of the antenna element is configured to be bent, and the bent portion is formed of a finer mesh than the mesh part or formed of a solid, a relationship between a line width W and a line interval D of the mesh part substantially satisfies D≥22W, and the line width W is equal to or greater than double a skin depth of a conductive material of the mesh part with respect to a target frequency of the antenna element.

10. The mobile device according to claim 9, further comprising:

a light emitting element; and a light emitting section configured to output light emitted from the light emitting element through at least the mesh part of the antenna element.

11. The mobile device according to claim 10, wherein the mobile device is a mobile telephone terminal, and at the time of receiving at least a telephone call or a message at the mobile telephone terminal, the light emitting section is configured to display an icon, a symbol, or a character.

* * * * *